US007095176B2

(12) United States Patent
Lynn

(10) Patent No.: US 7,095,176 B2
(45) Date of Patent: Aug. 22, 2006

(54) MINIATURE TUBULAR GAS DISCHARGE LAMP AND METHOD OF MANUFACTURE

(76) Inventor: Judd B. Lynn, P.O. Box 1989-505, Big Bear Lake, CA (US) 92315

( * ) Notice: Subject to any disclaimer, the term of this patent is extended or adjusted under 35 U.S.C. 154(b) by 0 days.

(21) Appl. No.: 10/945,208

(22) Filed: Sep. 20, 2004

(65) Prior Publication Data

US 2005/0200282 A1 Sep. 15, 2005

Related U.S. Application Data

(60) Provisional application No. 60/574,149, filed on May 26, 2004, provisional application No. 60/551,246, filed on Mar. 9, 2004.

(51) Int. Cl.
*H01J 61/30* (2006.01)

(52) U.S. Cl. ..... 313/634; 313/489; 313/635

(58) Field of Classification Search ..... 313/483, 313/485, 489, 594, 634, 635
See application file for complete search history.

(56) References Cited

U.S. PATENT DOCUMENTS 682,699 A 9/1901 Hewitt
2,182,732 A 12/1939 Meyer et al.
4,005,330 A 1/1977 Glascock, Jr. et al.
4,099,090 A 7/1978 Corth et al.
4,245,179 A 1/1981 Buhrer
5,211,467 A 5/1993 Seder
5,235,497 A 8/1993 Costa
5,479,089 A 12/1995 Lee
5,520,855 A 5/1996 Ito et al.
5,579,134 A 11/1996 Lengyel
5,602,444 A 2/1997 Jansma
5,607,222 A 3/1997 Woog
5,726,528 A 3/1998 Jansma et al.
5,798,608 A 8/1998 Shaw
5,808,407 A 9/1998 Chung et al.
5,952,792 A 9/1999 Borowiec et al.
5,959,405 A 9/1999 Soules et al.
6,135,620 A 10/2000 Marsh
6,348,763 B1 2/2002 Collins
2002/0153833 A1* 10/2002 Wu ..... 313/506

* cited by examiner

*Primary Examiner*—Vip Patel
(74) *Attorney, Agent, or Firm*—Knobbe, Martens, Olson & Bear, LLP

(57) ABSTRACT

A tubular gas discharge lamp and a method of manufacturing are disclosed. The method includes providing a tubular ingot having an outer surface with a first outer diameter. The method further includes drawing the tubular ingot to form a tube. The tube has a wall with an outer surface. The outer surface has a second outer diameter less than the first outer diameter. The wall is substantially transmissive to ultraviolet light. The method further includes applying at least one coating on the outer surface of the tube. The at least one coating includes a phosphor material.

17 Claims, 12 Drawing Sheets

MINIATURE TUBULAR GAS DISCHARGE LAMP AND METHOD OF MANUFACTURE

CLAIM OF PRIORITY

The present application claims the benefit of U.S. Provisional Application No. 60/551,246, filed Mar. 9, 2004 and U.S. Provisional Application No. 60/574,149, filed May 26, 2004, both of which are incorporated in their entireties by reference herein.

BACKGROUND OF THE INVENTION

1. Field of the Invention

This invention relates generally to gas discharge lamps, and more specifically to miniature or small-diameter gas discharge lamps and methods of manufacture.

2. Description of the Related Art

One type of gas discharge lamp is the traditional fluorescent tube lamp. These lamps are made by coating an inner surface of a glass tube with phosphor material, sealing a gas mixture (e.g., mercury vapor, neon, and argon) within the glass tube, and installing electrodes at the ends of the glass tube. The lamp is operated by applying sufficient electrical power to the electrodes (either AC or DC) to ionize the internal gas mixture of the lamp. Electrons traveling between the electrodes strike mercury atoms which react by generating ultraviolet light. This ultraviolet light strikes the phosphor material within the glass tube, and the phosphor material generates visible light in response. Other types of gas discharge lamps (e.g., neon lamps or ultraviolet sterilizing lamps) do not have an inner coating of phosphor material, and the gas sealed within the tube is selected to provide the desired wavelengths of light. Such lamps are typically formed in a batch process in which lamp tubes are bent, welded, or cut to shape and length, then coated with phosphor, fitted with electrodes, and then vacuum processed.

Fluorescent lamps with phosphor material inside the tube suffer from shortened life spans and reduced light generation due to various effects which degrade the phosphor material. For example, the phosphor material is damaged by heat from the arc stream, by exposure to mercury vapor which bonds to the phosphor material, and by sputtered materials from the electrodes depositing onto the phosphor material. In addition, in traditional lamp manufacturing, residual materials are removed from the phosphor suspension deposited onto the inner surface of the tube so that these residual materials do not outgas and contaminate the atmosphere inside the finished lamp. This removal process, termed "lehring," involves heating the coated tube and flushing it with air to burn out the residual suspension materials, and this heating can cause some degradation of the phosphor material. The glass tube is then filled with the desired gaseous atmosphere. This high-temperature lehring process contributes to the degradation of the phosphor material.

Furthermore, conventional gas discharge lamps utilize internal metallic electrodes with external electrical connections which are bonded to the glass tube by hermetic glass-to-metal seals at the tube ends. These glass-to-metal seals avoid leakage or contamination (e.g., by water vapor) of the gaseous atmosphere within the glass tube. They are formed by a process which includes vacuum baking the assembly to a final seal. This vacuum baking process to form the seals also contributes to the degradation of the phosphor material. Failure of these glass-to-metal seals also limits the lifetime of the gas discharge lamp.

It is difficult to miniaturize fluorescent lamps. As the diameters of fluorescent lamps are reduced, it becomes more and more difficult to employ conventional methods of manufacture. The small diameter of the tube creates difficulties in applying the phosphor material to the inner surface of the tube and in lehring and in vacuum baking the residual materials away, thereby limiting the length of the tube of the miniature fluorescent lamp. Existing procedures for applying the internal phosphor coating by flushing solvent-based or water-based phosphor suspensions through reduced-diameter tubes can produce inhomgeneities in the internal phosphor coating. In addition, conventional methods for forming electrodes and glass-to-metal seals present difficulties as the diameter of the gas discharge lamp is reduced.

SUMMARY OF THE INVENTION

Certain embodiments provide a method of manufacturing a tubular gas discharge lamp. The method comprises providing a tubular ingot having an outer surface with a first outer diameter. The method further comprises drawing the tubular ingot to form a tube. The tube has a wall with an outer surface. The outer surface has a second outer diameter less than the first outer diameter. The wall is substantially transmissive to ultraviolet light. The method further comprises applying at least one coating on the outer surface of the tube. The at least one coating comprises a phosphor material.

Certain embodiments provide a method of manufacturing a tubular gas discharge lamp. The method comprises providing a tubular ingot having a first outer diameter. The method further comprises drawing the tubular ingot to form a tube with a second outer diameter less than the first outer diameter. The method further comprises placing a lamp gas within the tube. The method further comprises hermetically sealing the lamp gas within the tube.

Certain embodiments provide a tubular lamp stock comprising a tube having an outer surface. The tube is substantially transmissive to ultraviolet light. The tubular lamp stock further comprises at least one coating on the tube. The tube and the at least one coating are integral with one another. The at least one coating comprises a phosphor material and a protective material. The protective material provides environmental protection and mechanical protection to the phosphor material.

Certain embodiments provide a tubular lamp stock comprising a tube having a length of at least 30 feet. The tubular lamp stock further comprises a lamp gas sealed within the tube.

Certain embodiments provide a tubular lamp stock comprising a tube having an outer surface. The tube is substantially transmissive to ultraviolet light. The tube has sufficient flexibility to flexibly bend along a bending radius equal to or less than approximately 6 feet. The tubular lamp stock further comprises at least one coating on the tube. The tube and the at least one coating are integral with one another. The at least one coating comprises a phosphor material.

Certain embodiments provide a tubular lamp stock comprising a tube having sufficient flexibility to flexibly bend along a bending radius equal to or less than approximately 6 feet. The tubular lamp stock further comprises a lamp gas sealed within the tube.

Certain embodiments provide a tubular lamp comprising a tube having an outer surface and an inner region containing a gas. The tube is substantially transmissive to ultraviolet light. The gas generates ultraviolet light in response to electrical excitation. The tubular lamp further comprises at least one electrode on the outer surface of the tube. The tubular lamp further comprises a phosphor material on the outer surface of the tube. The phosphor material generates visible light in response to excitation by ultraviolet light from the gas. The tubular lamp further comprises a protective material on the outer surface of the tube. The protective material provides environmental protection and mechanical protection to the phosphor material.

Certain embodiments provide a backlight assembly comprising a tubular lamp which generates visible light. The tubular lamp comprises a tube having an outer surface and an inner region containing a gas. The tube is substantially transmissive to ultraviolet light. The gas generates ultraviolet light in response to electrical excitation. The tubular lamp further comprises at least one electrode on the outer surface of the tube. The tubular lamp further comprises a phosphor material on the outer surface of the tube. The phosphor material generates visible light in response to excitation by ultraviolet light from the gas. The tubular lamp further comprises a protective material on the outer surface of the tube. The protective material provides environmental protection and mechanical protection to the phosphor material.

Certain embodiments provide a display assembly comprising a backlight assembly comprising a tubular lamp which generates visible light. The tubular lamp comprises a tube having an outer surface and an inner region containing a gas. The tube is substantially transmissive to ultraviolet light. The gas generates ultraviolet light in response to electrical excitation. The tubular lamp further comprises at least one electrode on the outer surface of the tube. The tubular lamp further comprises a phosphor material on the outer surface of the tube. The phosphor material generates visible light in response to excitation by ultraviolet light from the gas. The tubular lamp further comprises a protective material on the outer surface of the tube. The protective material provides environmental protection and mechanical protection to the phosphor material. The display assembly further comprises a liquid crystal display positioned to be illuminated by the visible light from the backlight assembly.

DETAILED DESCRIPTION OF THE PREFERRED EMBODIMENT

Figure 1:
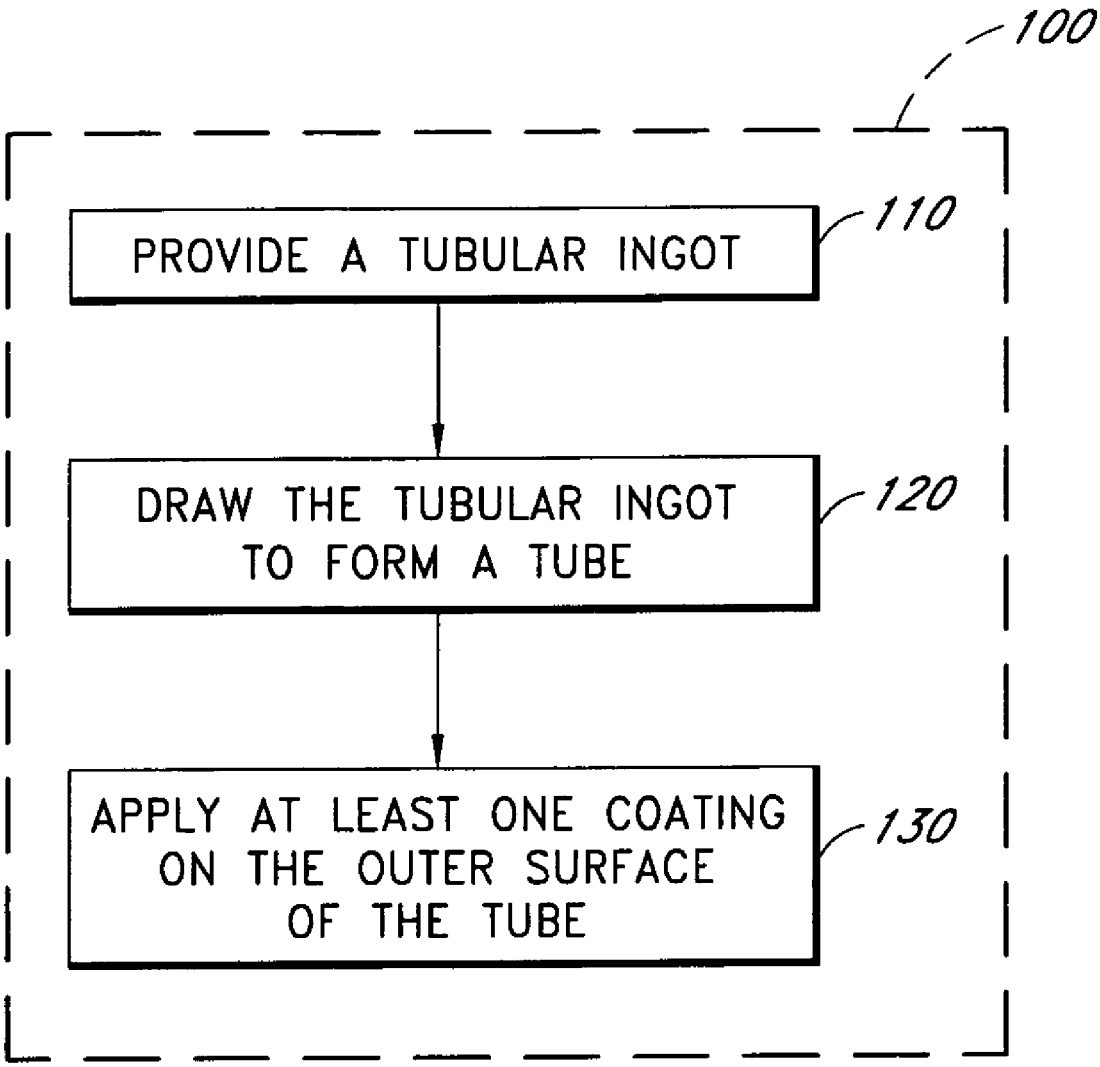
FIG. 1 is a flowchart of an exemplary embodiment of a method of manufacturing a tubular discharge lamp.
Figure 2:
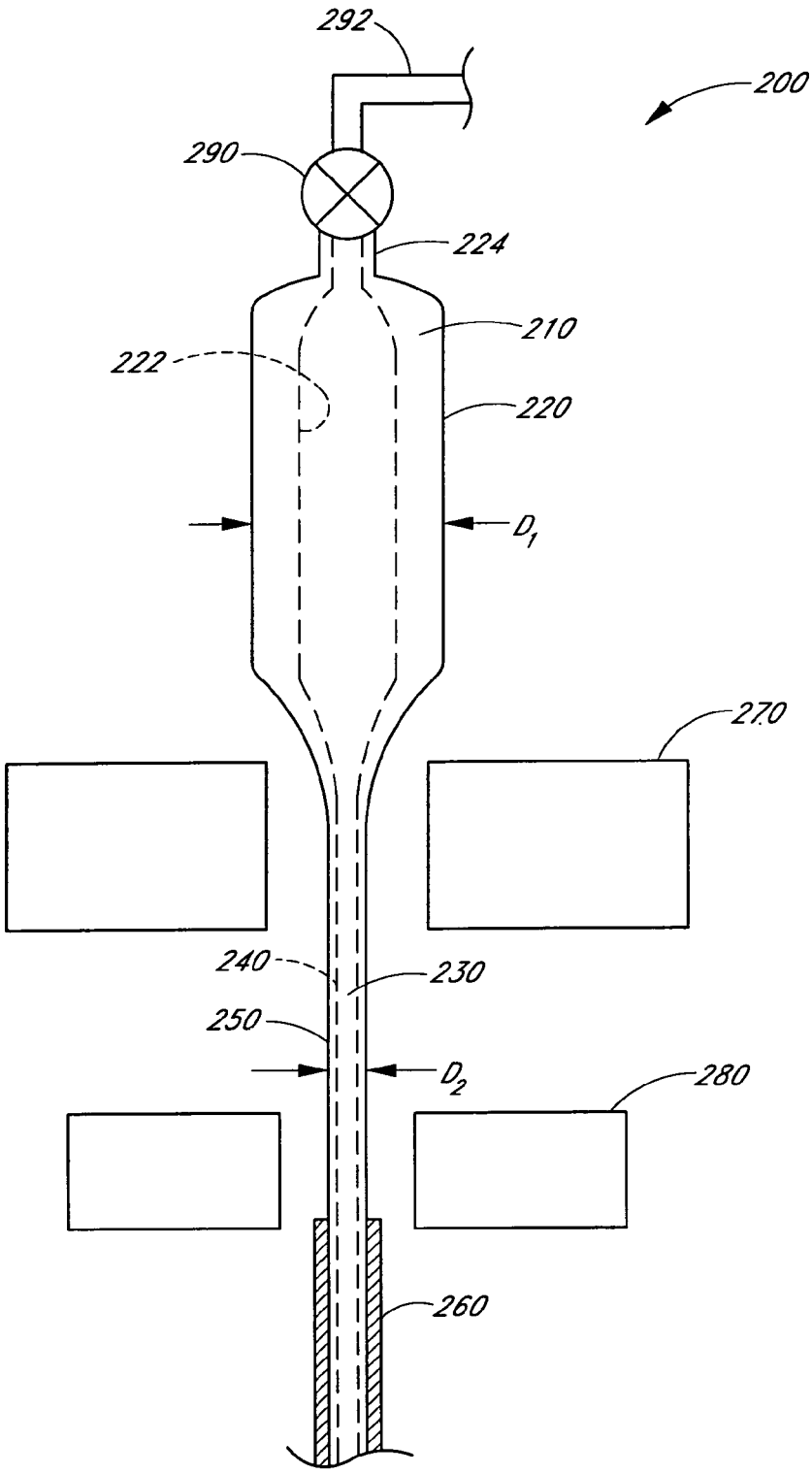
FIG. 2 schematically illustrates an exemplary apparatus for manufacturing a tubular discharge lamp.

FIG. 1 is a flowchart of an exemplary embodiment of a method 100 of manufacturing a tubular discharge lamp and FIG. 2 schematically illustrates an exemplary apparatus 200 for manufacturing a tubular discharge lamp. The method 100 comprises providing a tubular ingot 210 having an outer surface 220 with a first outer diameter $D_1$ in an operational block 110. The method 100 further comprises drawing the tubular ingot 210 to form a tube 230 in an operational block 120. The tube 230 has a wall 240 with an outer surface 250. The outer surface 250 has a second outer diameter $D_2$ less than the first outer diameter $D_1$. The wall 240 is substantially transmissive to ultraviolet light. The method 100 further comprises applying at least one coating 260 on the outer surface 250 of the tube 230 in an operational block 130. In certain embodiments, the at least one coating 260 comprises a phosphor material. As described more fully below, in certain embodiments, as schematically illustrated by FIG. 2, the apparatus 200 comprises a drawing subsystem 270, a coating subsystem 280, and an ingot valve 290 fluidly coupled to a first end 224 of the tubular ingot 210 and to a tubulation 292.

In certain embodiments, the tubular ingot 210 comprises a material selected from the group consisting of silica, quartz, soda lime glass, flint glass, and borosilicate glass. Other types of glass are also compatible with embodiments described herein. In certain embodiments, the material of the tubular ingot 210 is substantially transmissive to ultraviolet radiation (e.g., for fluorescent lamps or ultraviolet sterilizer lamps), while in other embodiments, the material is substantially transmissive to visible light (e.g., for neon lamps). In certain embodiments, the first outer diameter $D_1$ of the outer surface 220 of the tubular ingot 210 is in a range between approximately 1 inch and approximately 6 inches. In certain embodiments, the inner surface 224 of the tubular ingot 210 has an inner diameter in a range between approximately 0.8 inch to approximately 5 inches. In certain embodiments, the length of the tubular ingot 210 is in a range between approximately 6 inches to approximately 6 feet.

Providing the Tubular Ingot

Figure 3:
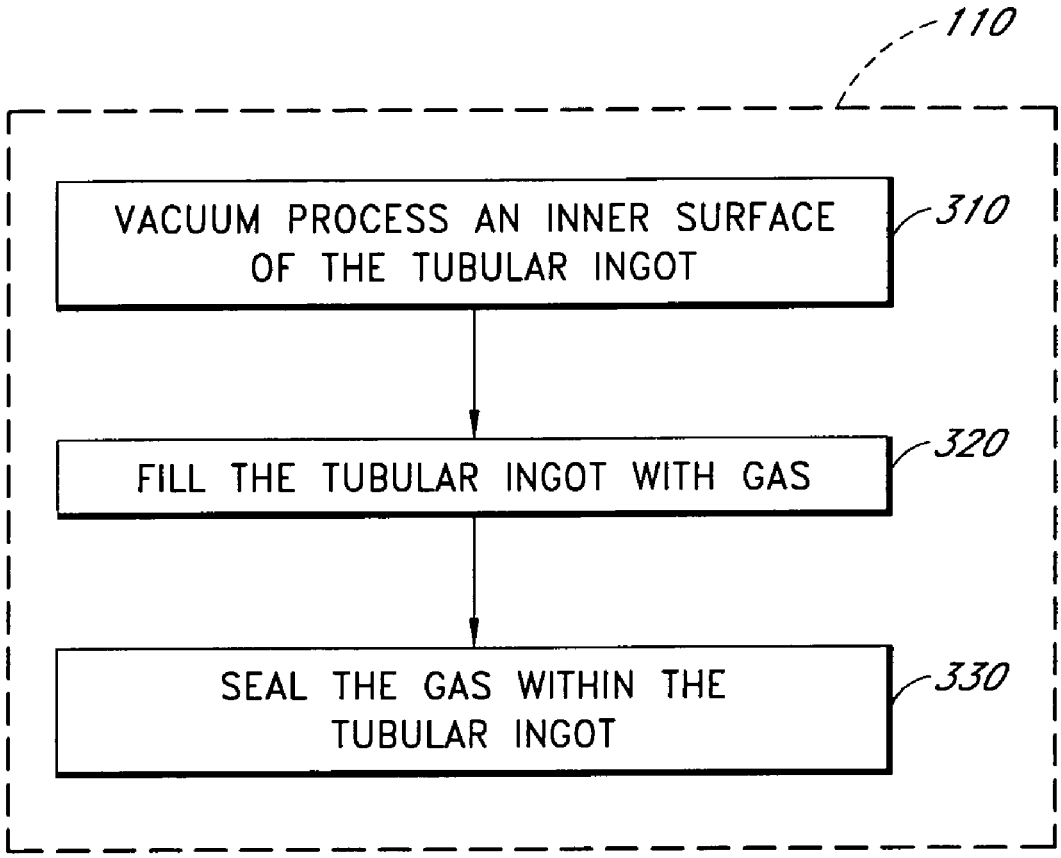
FIG. 3 is a flowchart of a process for providing the tubular ingot in accordance with embodiments described herein.

In certain embodiments, a tubular ingot 210 is provided and installed in the apparatus 200 without vacuum processing the tubular ingot 210. However, in certain other embodiments, the tubular ingot 210 is advantageously vacuum processed prior to the drawing process. One process for providing the tubular ingot 210 in accordance with such embodiments is shown by the flowchart of FIG. 3. An inner surface 222 of the tubular ingot 210 is vacuum processed by forming a vacuum within the tubular ingot 210 and heating the tubular ingot 210 in an operational block 310. An exemplary vacuum pressure for the vacuum is approximately $10^{-6}$ Torr at temperatures greater than approximately 400 degrees Celsius. In an operational block 320, the tubular ingot 210 is filled with gas at approximately atmospheric pressure. In certain embodiments, the gas is dry and contaminant-free, and comprises at least one relatively inert gas selected from the group consisting of helium, neon, argon, xenon, and nitrogen. In an operational block 330, the gas is sealed within the tubular ingot 210.

By vacuum processing the tubular ingot 210 (e.g., by outgassing various contaminants from the inner surface 222 and pumping them out of the tubular ingot 210), such embodiments advantageously remove the contaminants from the inner surface 222 of the tubular ingot 210. Examples of such contaminants include, but are not limited to, water, $CO_2$, $CH_4$, and ammonia. Certain such embodiments also advantageously avoid problems associated with vacuum processing the small-diameter tube 230 formed after the drawing process. In addition, certain such embodiments, in which a phosphor material is applied to the tube 230, as described more fully below, advantageously avoid exposing the phosphor material to an elevated manufacturing process temperature which would otherwise contribute to the degradation of the phosphor material.

Figure 4:
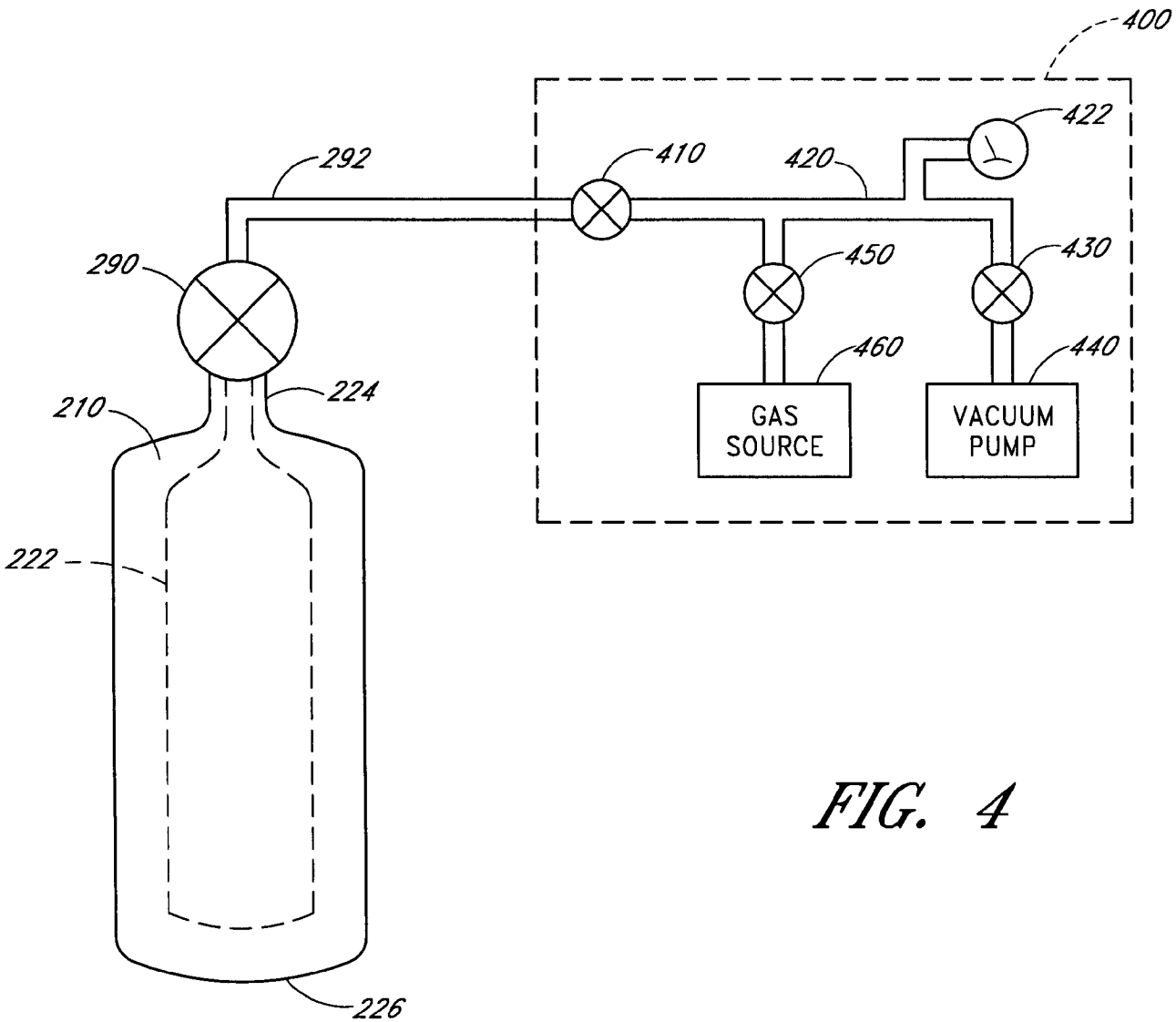
FIG. 4 schematically illustrates an exemplary configuration compatible with the process of FIG. 3.

FIG. 4 schematically illustrates an exemplary configuration compatible with the process of FIG. 3. A first port of the ingot valve 290 is glass-welded onto a first end 224 of the tubular ingot 210 and a second port of the ingot valve 290 is glass-welded to the tubulation 292. In certain embodiments, the ingot valve 290 comprises a quartz glass ball cock valve. A second end 226 of the tubular ingot 210 is sealed closed (e.g., by glass welding). The inner surface 222 of the tubular ingot 210 is fluidly coupled to a gas processing system 400 through the ingot valve 290 and the tubulation 292. The gas processing system 400 comprises a manifold valve 410 coupled to the tubulation 292, a manifold 420, a gas pressure sensor 422, a vacuum valve 430, a vacuum pump 440, a gas valve 450, and a gas source 460. In certain embodiments, at least one of the manifold valve 420, the vacuum valve 430, and the gas valve 450 comprises a gas pressure regulator which can be adjustably opened or closed to provide a selected vacuum pressure within the manifold 420.

In certain embodiments, the tubular ingot 210 is pumped out by fluidly coupling the vacuum pump 440 to the inner surface 222 of the tubular ingot 210 through the manifold 420. For example, by opening the ingot valve 290, opening the manifold valve 410, opening the vacuum valve 430, and closing the gas valve 450, the vacuum pump 440 pumps out the tubular ingot 210 to a selected vacuum pressure as measured by the gas pressure sensor 422. The tubular ingot 210 of certain embodiments is heated during the pumping to facilitate outgassing of contaminants from the inner surface 222 of the tubular ingot 210. In certain embodiments, the tubular ingot 210 is heated to temperatures which are approximately equal to or less than the softening temperature of the tubular ingot 210. Other embodiments heat the tubular ingot 210 to approximately 400 degrees Celsius while pumping out the contaminants.

Once the tubular ingot 210 has reached a predetermined vacuum pressure (e.g., $10^{-6}$ Torr), as indicated by the gas pressure regulator 422, the vacuum pump 440 is sealed from the manifold 420 by closing the vacuum valve 430. In other embodiments, one or more preselected constituents of the gas being pumped out of the tubular ingot 210 (e.g., water vapor) are monitored, and the vacuum pump 440 is sealed from the manifold 420 once the preselected gas constituent reaches a predetermined acceptable level. After sealing off the vacuum pump 440, the gas source 460 is then opened to the manifold 420 by opening the gas valve 450 to introduce the gas into the tubular ingot 210. Once the tubular ingot 210 is filled to a predetermined gas pressure (e.g., greater than or equal to approximately atmospheric pressure), the gas is sealed within the tubular ingot 210 by closing the ingot valve 290, thereby reversibly sealing the first end 224 of the tubular ingot 210. In certain embodiments, pump down and the gas fill process is repeated to additionally flush out contaminants. The gas processing system 400 is then decoupled from the tubular ingot 210 (e.g., by separation of the tubulation 292 from the manifold valve 410).

In certain other embodiments, the tubulation 292 is glass-welded directly to the first end 224 of the tubular ingot 210 without an ingot valve 290. The gas is then sealed within the tubular ingot 210 by sealing the tubulation 292 (e.g., by torch sealing or hot pliers sealing). In certain embodiments, both the first end 224 and the second end 226 of the tubular ingot 210 have tubulations. In certain such embodiments, the inner surface 222 of the tubular ingot 210 is pumped through at least one of the tubulations during vacuum processing. In certain embodiments, prior to filling the tubular ingot 210 with gas, one of these tubulations is sealed off. After filling the tubular ingot 210 with gas, the other tubulation is sealed off, thereby sealing the gas within the tubular ingot 210.

In certain embodiments, the gas processing system 400 is separate from the apparatus 200 and the process of providing the tubular ingot 210 in the operational block 110 is performed off-site from the other portions of the method of manufacturing the tubular discharge lamp. In other embodiments, the gas processing system 400 and the apparatus 200 are portions of a single apparatus. Other methods and gas processing systems for vacuum processing the tubular ingot 210, and sealing gas within the tubular ingot 210 are compatible with embodiments described herein.

Drawing the Tubular Ingot to Form a Tube

In certain embodiments, the apparatus 200 includes a drawing subsystem 270 configured to heat the tubular ingot 210 to a temperature above the softening temperature of the tubular ingot 210. The drawing subsystem 270 is also configured to controllably draw or pull the heated tubular ingot 210 at a preselected rate, causing the tubular ingot 210 to elongate and to reduce its diameter, thereby forming the tube 230. Drawing subsystems 270 (sometimes referred to as redraw towers) compatible with embodiments described herein are known in the art of capillary tube and optical fiber processing.

Figure 5:
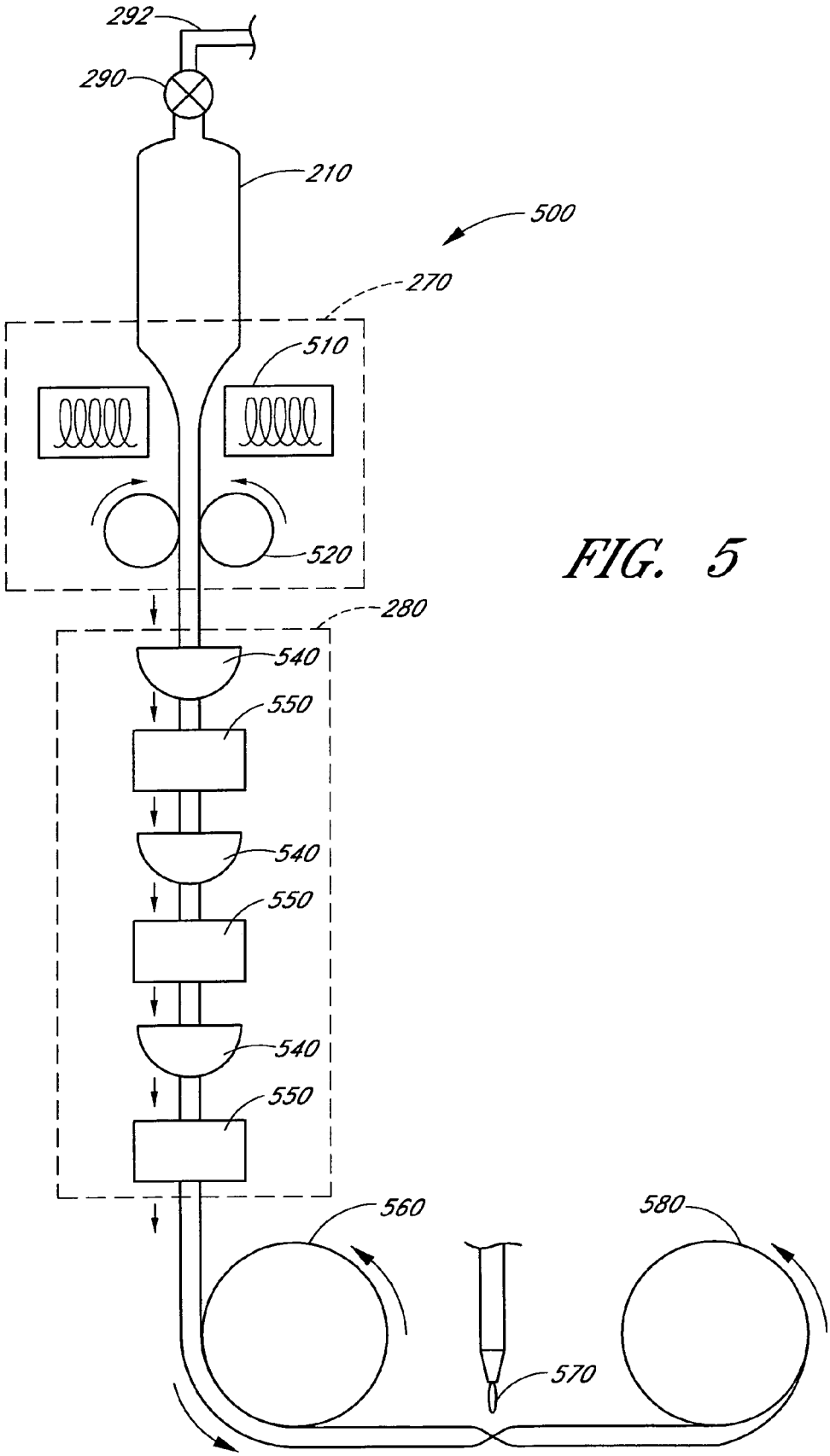
FIG. 5 schematically illustrates an exemplary drawing tower compatible with embodiments described herein.

FIG. 5 schematically illustrates an exemplary drawing tower 500 compatible with embodiments described herein in which the tubular ingot 210 is installed. The drawing tower 500 includes a drawing subsystem 270 and a coating subsystem 280. The drawing subsystem 270 comprises a furnace 510 configured to heat at least a portion of the tubular ingot 210 to a temperature above a softening temperature of the tubular ingot 210. The drawing subsystem 270 further comprises a tractor mechanism 520 configured to draw one end of the tubular ingot 210 through the drawing tower 500 (in the direction shown by the arrows) to form the tube 230. Drawing subsystems 270 compatible with embodiments described herein are based on optical fiber processing tools and are known to persons skilled in the art.

The drawing tower 500 of certain embodiments further includes a capstan 560 around which the tube 230 bends and which provides tension to the tube 230. In certain embodiments, the drawing tower 500 further comprises one or more sensors (not shown) configured to monitor selected characteristics of the tube 230 (e.g., outer diameter, inner diameter, wall thickness, coating concentricity) during the drawing process. Such drawing towers 500 compatible with embodiments described herein are known to persons skilled in the art.

In certain embodiments, the tube 230 has an outer diameter $D_2$ which is equal to or less than approximately 3 millimeters, while in other embodiments, $D_2$ is equal to or less than approximately 2 millimeters, and in still other embodiments, $D_2$ is equal to or less than approximately 1 millimeter. In certain embodiments, the tube 230 has an inner diameter which is equal to or less than approximately 3 millimeters, while in other embodiments, the inner diameter is equal to or less than approximately 2 millimeters, and in still other embodiments, the inner diameter is equal to or less than approximately 1 millimeter. In certain embodiments, the tube 230 has a wall thickness which is equal to or less than approximately 0.3 millimeter, while in other embodiments, the wall thickness is equal to or less than approximately 0.2 millimeter, and in still other embodiments, the wall thickness is equal to or less than approximately 0.1 millimeter. For example, an exemplary tube 230 has an outer diameter of approximately 0.75 millimeter, an inner diameter of approximately 0.65 millimeter, and a wall thickness of approximately 0.05 millimeter.

In certain embodiments, the outer diameter $D_1$ of the tubular ingot 210 is in a range between approximately 8 times larger and approximately 500 times larger than the outer diameter $D_2$ of the tube 230. In other embodiments, the outer diameter $D_1$ is in a range between approximately 30 times larger and approximately 150 times larger than the outer diameter $D_2$. In still other embodiments, the outer diameter $D_1$ is equal to or greater than approximately ten times larger than the outer diameter $D_2$.

In certain embodiments, the tube 230 has a generally circular cross-section in a plane generally perpendicular to the longitudinal axis of the tube 230. In other embodiments, the cross-section of the tube 230 can be oval, rectangular, triangular, or any other geometrical or arbitrary shape.

By forming the tube 230 using a drawing process, certain embodiments described herein advantageously provide tubular lamp stock which is significantly longer than the gas discharge lamp eventually formed. Such tubular lamp stock can be easily stored, handled, and subsequently processed to form many gas discharge lamps. In addition, the drawing process of certain embodiments produces superior tubular lamp stock (e.g., more uniformity) in higher volumes and for lower costs than do conventional techniques.

Applying at Least One Coating on the Outer Surface of the Tube

In certain embodiments, the apparatus 200 further includes a coating subsystem 280 configured to apply the at least one coating 260 on the outer surface 250 of the tube 230. As described more fully below, tubular lamp stocks with various combinations of coatings are compatible with embodiments described herein. In certain embodiments, the coating subsystem 280 comprises a bath in which the tube 230 is immersed, thereby depositing the at least one coating 260 onto the outer surface 250 of the tube 230. Other methods of depositing the at least one coating 260 in accordance with embodiments described herein, include but are not limited to, spraying or rolling the at least one coating 260 on the outer surface 250 of the tube 230 and vacuum deposition techniques such as chemical vapor deposition and vacuum sputtering.

In certain embodiments, the coating subsystem 280 is further configured to dry the at least one coating 260. In certain embodiments, the at least one coating 260 is dried by exposing the at least one coating 260 to radiant heat (e.g., baking the at least one coating 260). Other methods of drying the at least one coating 260 include, but are not limited to, exposing the at least one coating 260 to a flow of filtered air or ultraviolet curing radiation. Selection of the appropriate coating deposition and coating drying processes depend in part on the coating material and thickness being applied.

In certain embodiments, the at least one coating 260 is applied concurrently with drawing the tubular ingot 210 to form the tube 230. The process of applying the at least one coating 260 in certain such embodiments is integral with the process of drawing the tubular ingot 210 to form the tube 230. In other embodiments, the at least one coating 260 is applied subsequently to drawing the tubular ingot 210 to form the tube 230. In certain such embodiments, the process of applying the at least one coating 260 is completely separate from the process of drawing the tubular ingot 210 to form the tube 230.

In certain embodiments, the coating subsystem 280 of the drawing tower 500 comprises a plurality of coating stations 540, each of which is configured to apply a selected material to the tube 230 and a plurality of curing stations 550, each of which is configured to cure the previously-applied material from one or more of the coating stations 540. In certain embodiments, at least one of the curing stations 550 heats the tube 230 to cure the corresponding coating, while in other embodiments, at least one of the curing stations 550 utilizes ultraviolet radiation to cure the corresponding coating. While the drawing tower 500 of FIG. 5 comprises three coating stations 540 and three curing stations 550, other drawing towers 500 compatible with embodiments described herein include other numbers (e.g., 1, 2, 4, or more) of coating stations 540 and other numbers (e.g., 1, 2, 4, or more) of curing stations 550. Furthermore, other drawing towers 500 compatible with embodiments described herein do not have the same number of coating stations 540 as curing stations 550.

Sealing the Tube

In certain embodiments, the tube 230 is formed with a dry and contaminant-free gas sealed therein. As described above, in certain embodiments, the tubular ingot 210 has a dry and contaminant-free gas (e.g., helium, neon, argon, xenon, nitrogen, or other relatively inert gas) sealed therein. In certain such embodiments, the gas within the tubular ingot 210 remains within the tube 230 during the drawing process. After bending around the capstan 560, the gas-containing tube 230 is sealed at preselected intervals (e.g., by a flame 570 which locally heats and pinches off portions of the tube 230). The portions of the tube 230 are then separated from one another while remaining sealed, thereby forming a plurality of tubes 230 each having gas hermetically sealed within.

In certain other embodiments, dry, contaminant-free gas is supplied to the tubular ingot 210 and to the tube 230 during the drawing process. As schematically illustrated by FIG. 5, a regulated source (not shown) of dry, contaminant-free gas is fluidly coupled to the tubular ingot 210 through the ingot valve 290 and the tubulation 292. In certain embodiments, the tubulation 292 is repeatably filled with gas and pumped down prior to opening the ingot valve 290, thereby reducing the possibility of water vapor or other contaminants getting into the tubular ingot 210. The gas pressure supplied to the tubular ingot 210 and to the tube 230 is controlled in certain embodiments to facilitate the drawing process and formation of the tube 230.

Tubes 230 with gas sealed therein and with lengths equal to the preselected interval are stored for use as tubular lamp stock. In certain embodiments, the preselected interval is at least 12 feet, at least 30 feet, or at least 100 feet. Thus, the tubes 230 of certain embodiments are produced by a continuous process in long continuous lengths. These long lengths of tubular lamp stock are then subsequently divided into tube segments having the desired lamp length (e.g., between approximately 1 inch and approximately 40 inches). In certain other embodiments, the preselected interval is approximately equal to the desired lamp length.

In certain embodiments, the tubes 230 have sufficient flexibility to be flexibly bent along a bending radius and coiled in rolls. In certain such embodiments, the sealed tubes 230 are wound by a winding mechanism 580. In certain embodiments, the bending radius is less than or equal to approximately 6 feet, while in certain other embodiments, the bending radius is less than or equal to approximately 4 feet, and in still other embodiments, the bending radius is less than or equal to approximately 2 feet. Such tubes 230 are significantly more flexible than tubes previously used for gas discharge lamps.

Certain embodiments advantageously provide tubes 230 with a controlled atmosphere hermetically sealed therein. This internal atmosphere of the tube 230 is selected in certain embodiments to be dry and contaminant-free to avoid contamination inside the tube 230. Such an internal atmosphere advantageously simplifies the subsequent processing to manufacture tubular discharge lamps using the tube 230 as a tubular lamp stock.

Unlike conventional lamp manufacturing processes, by vacuum processing the tubular ingot 210, certain embodiments described herein do not require a vacuum bake of the tube 230 (e.g., 300–400 degrees Celsius at hard vacuum) to purify the internal atmosphere within the tube 230. For tubes 230 with coatings comprising phosphor material, such vacuum baking would degrade the phosphor material by exposing the phosphor material to an elevated temperature. Furthermore, certain embodiments advantageously provide more uniformity among the tubes 230 and advantageously reduce manufacturing costs.

As described more fully below, in certain embodiments, the gas sealed within the tube 230 is later replaced by a gas comprising a lamp gas. However, in certain other embodiments, the gas sealed within the tube 230 already comprises a lamp gas. In certain such embodiments in which the gas is at a higher pressure than the desired lamp gas pressure, the gas is pumped out to the desired lamp gas pressure.

At Least One Coating

FIGS. 6A–6G and FIG. 7 schematically illustrate various embodiments of a tubular lamp stock 600 having at least one coating 260 formed in accordance with embodiments described herein. The tubular lamp stock 600 comprises a tube 230 having an outer surface 250. The tubular lamp stock 600 further comprises at least one coating 260 on the tube 230. The tube 230 and the at least one coating 260 are integral with one another. A tubular lamp stock 600 formed using the methods and apparatus described above in certain embodiments has a length of at least 12 feet. In other embodiments, the tubular lamp stock 600 has a length of at least 30 feet, while in other embodiments, the tubular lamp stock 600 has a length of at least 100 feet.

In certain embodiments in which the tube 230 is a component of a fluorescent lamp or an ultraviolet sterilizing lamp, the tube 230 is substantially transmissive to ultraviolet light at at least one wavelength emitted by the gas contained within the tube 230. In certain other embodiments in which the tube 230 is a component of a neon lamp, the tube 230 is substantially transmissive to visible light at at least one wavelength emitted by the gas contained within the tube 230.

In certain embodiments, as schematically illustrated by FIGS. 6A–6G, the at least one coating 260 comprises a phosphor material 610. Such embodiments are compatible with use of the tubular lamp stock 600 to manufacture fluorescent lamps. In certain embodiments, the phosphor material 610 comprises a halo phosphate lamp phosphor. Other phosphor materials 610 compatible with embodiments described herein include, but are not limited to, rare-earth phosphors, double photon phosphors, thin film phosphors, and encapsulated phosphors. In certain embodiments, the phosphor material 610 has a thickness of approximately 0.002 inch, while in other embodiments, the phosphor material 610 has a thickness in a range between approximately 0.0005 inch and approximately 0.005 inch. In certain embodiments (e.g., in which a thin-film phosphor is used), the phosphor material 610 has a thickness less than approximately 0.0005 inch.

In certain embodiments, the phosphor material 610 is applied by mixing the phosphor material 610 with a liquid (e.g., alcohol), and applying the mixture to the tube 230. After the liquid evaporates, the phosphor material 610 clings to the tube 230 by electrostatic forces. Subsequent coatings are then applied over the phosphor material 610 in certain embodiments.

In certain embodiments, the phosphor material 610 further comprises an adhesive which bonds the phosphor material 610 on the tube 230. The adhesive of certain embodiments comprises the same material as does the protective material 620, described more fully below, but with a thickness and viscosity selected to facilitate bonding the phosphor material 610 on the tube 230. Exemplary adhesives compatible with such embodiments include, but are not limited to, silicone, acetate, and acrylic. The adhesive of certain embodiments has a thickness in a range between approximately 0.0005 inch and 0.001 inch. In certain embodiments, the adhesive and the phosphor of the phosphor material 610 are applied concurrently to form a mixture on the tube 230. In other embodiments, the adhesive and the phosphor of the phosphor material 610 are applied sequentially to the tube 230.

In certain embodiments, the at least one coating 260 further comprises a protective material 620. The protective material 620 is applied on the tube 230 and provides environmental protection and mechanical protection to the phosphor material 610. In certain embodiments, the protective material 620 comprises silicone or acrylic plastic. Other protective materials 620 compatible with embodiments described herein include, but are not limited to, polyimide. In certain embodiments, the protective material 620 has a thickness of approximately 0.005 inch.

Figure 6A:
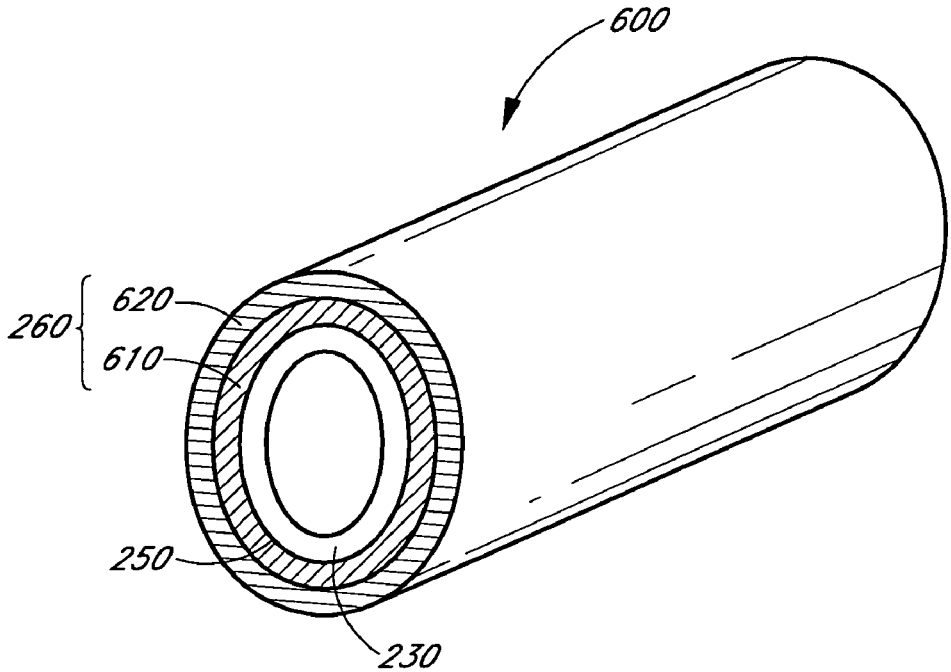
FIGS. 6A–6G schematically illustrate various embodiments of a tubular lamp stock having at least one coating comprising a phosphor material and which is formed in accordance with embodiments described herein.
Figure 6B:
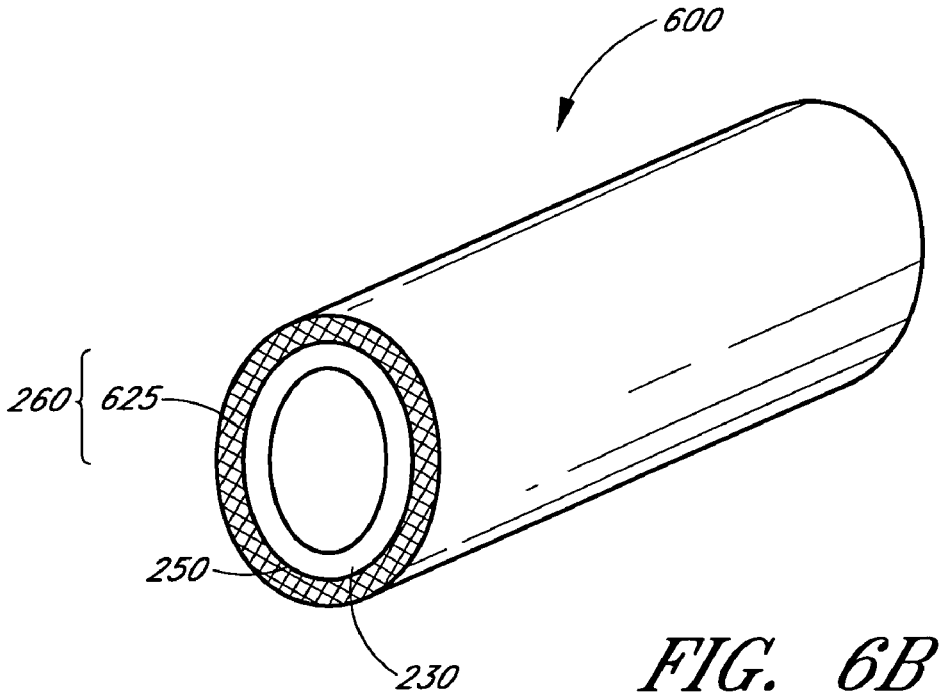

In the embodiment schematically illustrated by FIG. 6A, the phosphor material 610 contacts the outer surface 250 of the tube 230 and the protective material 620 contacts the phosphor material 610. In such embodiments, the phosphor material 610 is applied directly onto the outer surface 250 of the tube 230 and the protective material 620 is applied directly onto the phosphor material 610, thereby forming a multilayered structure. In the embodiment schematically illustrated by FIG. 6B, a mixture 625 of both the phosphor material 610 and the protective material 620 is applied directly onto the outer surface 250 of the tube 230, with the phosphor material 610 and the protective material 620 in a single layer.

Figure 6C:
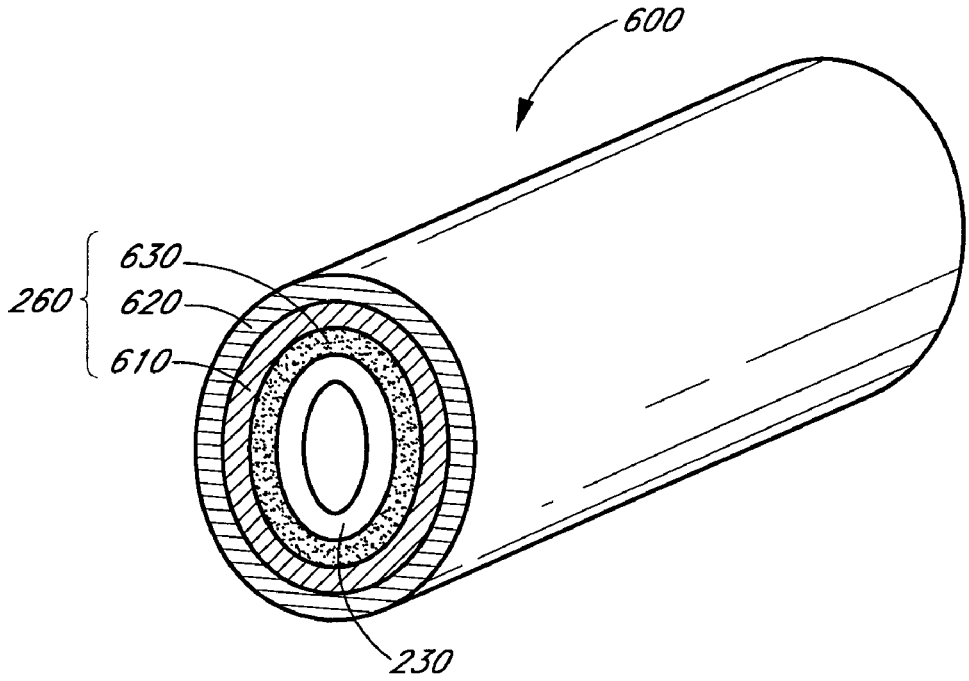
Figure 6D:
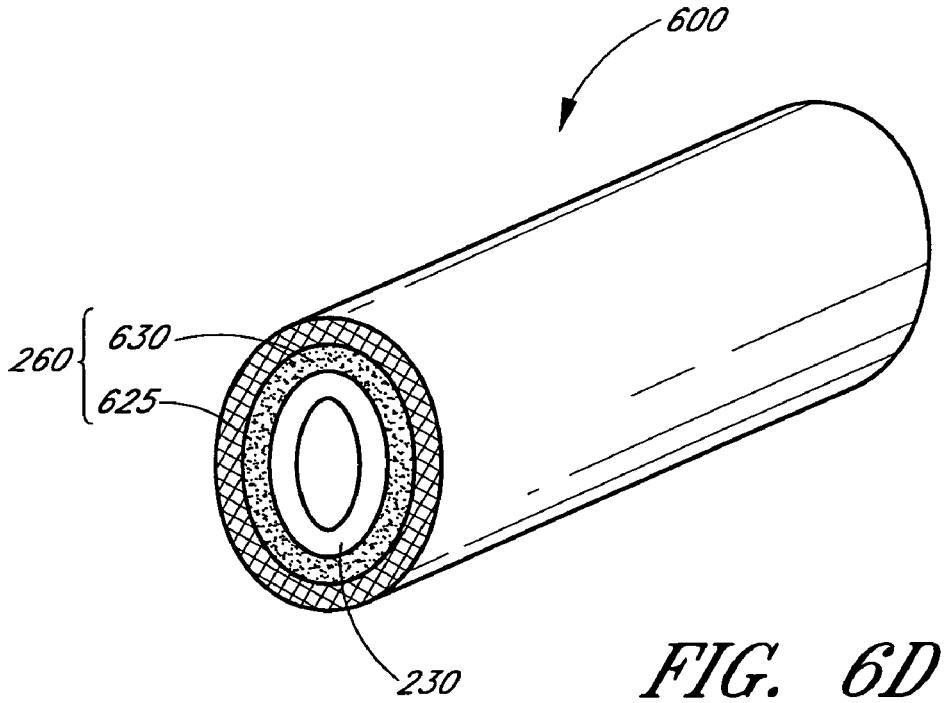

In the embodiment schematically illustrated by FIG. 6C, an intervening material 630 is applied between the outer surface 250 of the tube 230 and the phosphor material 610. The protective material 620 is applied on the phosphor material 610. In the embodiment schematically illustrated by FIG. 6D, the intervening material 630 is applied between the outer surface 250 of the tube 230 and the mixture 625 of the phosphor material 610 and the protective material 620. In certain embodiments, the intervening material 630 has a thickness of less than approximately 0.001 inch.

In certain embodiments, the intervening material 630 is substantially transmissive to ultraviolet light and is substantially reflective to visible light. The intervening material 630 thus allows a portion of the ultraviolet light to pass through to the phosphor material 610 and reflects a portion of the visible light originally propagating from the phosphor material 610 towards the tube 230 to propagate back through the phosphor material 610 and away from the tube 230. Certain such embodiments thus enhance the yield of visible light from the lamp. Exemplary intervening materials 630 compatible with certain embodiments described herein include, but are not limited to, alumina ($Al_2O_3$). In certain embodiments, the intervening material 630 comprises a multilayer dielectric film structure which serves as a band-pass filter of selected ranges of light wavelengths.

In certain embodiments, the intervening material 630 has an index of refraction approximately equal to the refractive index of the tube 230. The intervening material 630 of certain such embodiments comprises acrylic or polycarbonate.

Figure 6E:
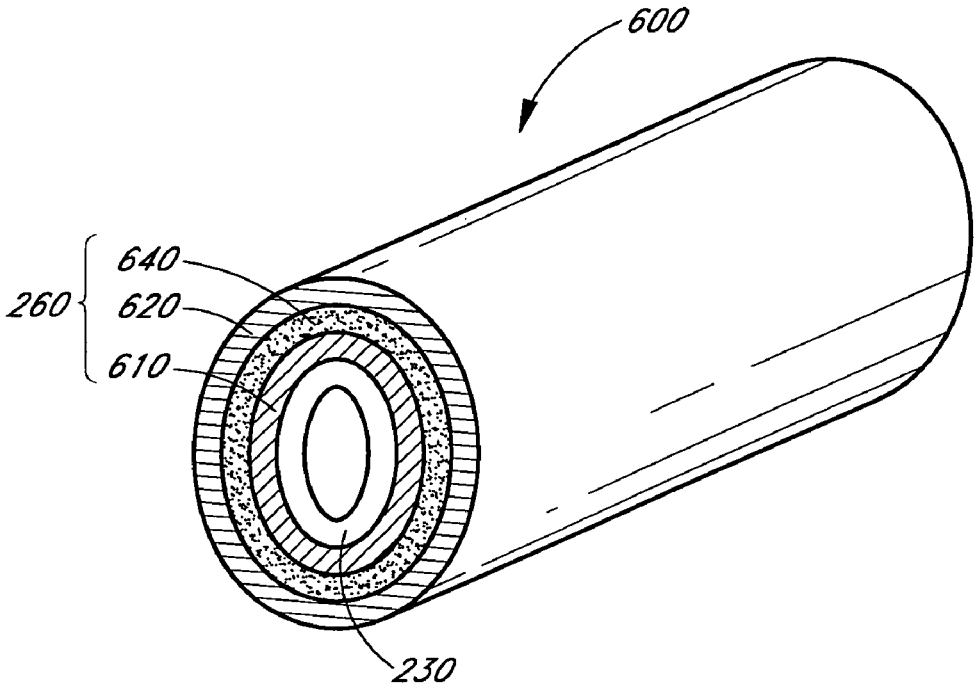
Figure 6F:
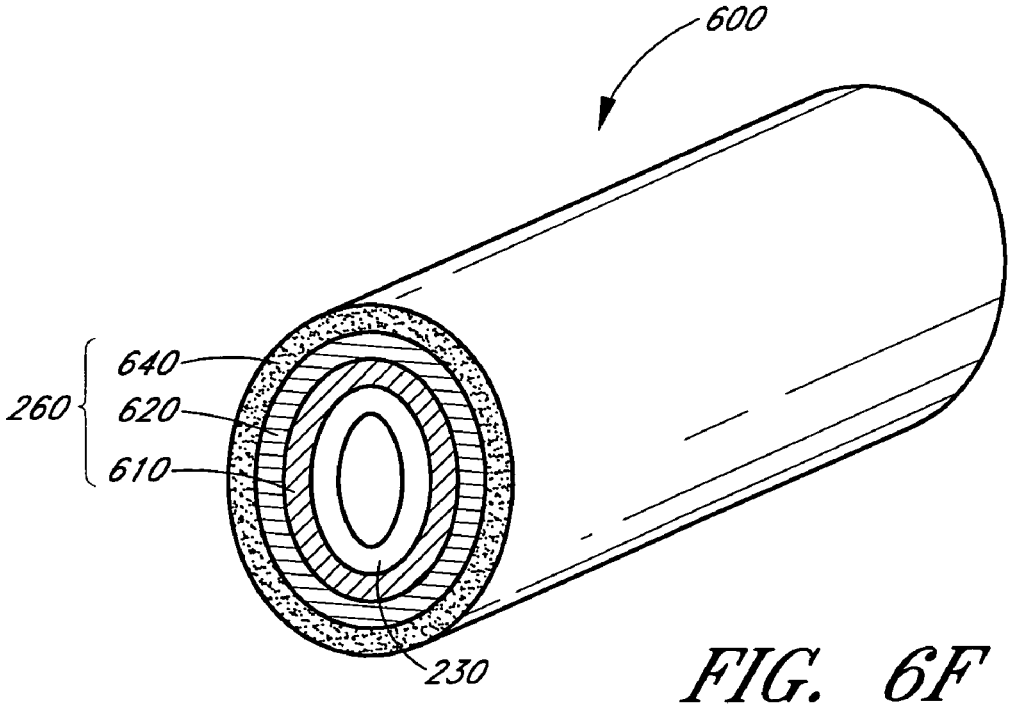

In the embodiment schematically illustrated by FIG. 6E, an optical material 640 is applied on the tube 230 as a second intervening material between the phosphor material 610 and the protective material 620. In the embodiment schematically illustrated by FIG. 6F, the optical material 640 is applied on the tube 230 and over the protective material 620. In certain embodiments, the optical material 640 is substantially reflective to ultraviolet light and is substantially transmissive to visible light. The optical material 640 thus allows a portion of the visible light to pass through the optical material 640 away from the tube 230 while reflecting a portion of the ultraviolet light originally propagating from the phosphor material 610 away from the tube 230 to propagate back through the phosphor material 610 towards the tube 230. In certain embodiments, the optical material 640 reflects more than 75% of the ultraviolet light impinging on the optical material 640 from the tube 230. Exemplary optical materials 640 compatible with certain embodiments described herein include, but are not limited to, magnesium oxide (MgO). In certain embodiments, the optical material 640 comprises a multilayer dielectric film structure which serves as a band-pass filter of selected ranges of light wavelengths.

Certain such embodiments enhance the yield of visible light from the lamp by reflecting ultraviolet light back through the phosphor material 610 thereby increasing the probability of interaction of the ultraviolet light with the phosphor material 610. Certain such embodiments protect against undesired emission of ultraviolet light from the tube 230. By using an integral coating 260 comprising an ultraviolet-reflective and visible-transmissive optical material 640, certain embodiments advantageously provide fail-safe protection against undesired ultraviolet emissions from the lamp. In such embodiments, the at least one coating 260 is not separable or removable from the lamp so the lamp can not be operated without this protective optical material 640 in place.

Exemplary optical materials 640 compatible with embodiments described herein include, but are not limited to, magnesium oxide or aluminum oxide, in various particulate or transparent forms. While the embodiments of FIGS. 6E and 6F have the optical material 640 and the protective material 620 applied sequentially on the tube 230, in other embodiments, the optical material 640 and the protective material 620 are applied concurrently to form a mixture on the tube 230.

Figure 6G:
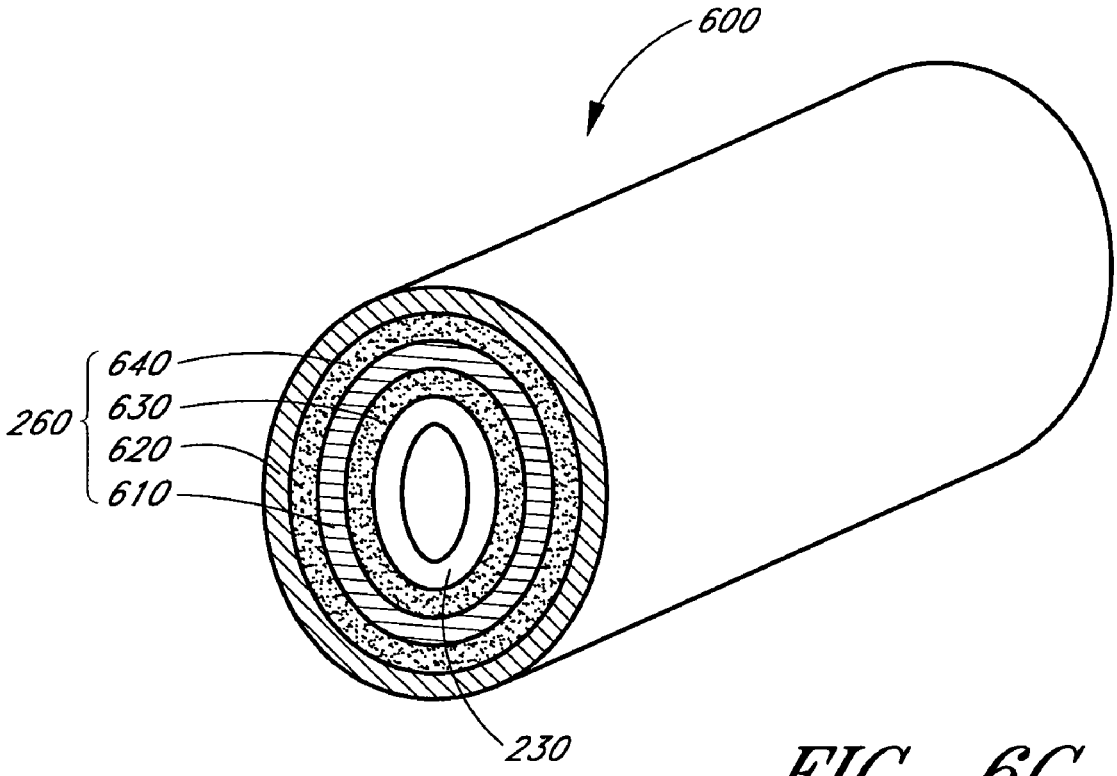

The embodiment schematically illustrated by FIG. 6G includes an intervening material 630 in contact with the outer surface 250 of the tube 230, a phosphor material 610 in contact with the intervening material 630, an optical material 640 in contact with the phosphor material 610, and a protective material 620 in contact with the optical material 640. In certain embodiments, the phosphor material 610 is within approximately 0.1 millimeter of the outer surface of the coating 260 on the tube 230. Other tubular lamp stocks 600 with other combinations, permutations, mixtures, and subsets of the phosphor material 610, the protective material 620, the intervening material 630, and the optical material 640 than those described above and in FIGS. 6A–6G are also compatible with embodiments described herein.

By coating the phosphor material 610 on the outside of the tube 230, certain embodiments described herein advantageously avoid the lehring processing steps of conventional lamp processing techniques. In addition, the external phosphor material 610 is isolated from the mercury vapor and the damaging effects of exposure to the arc stream within the tube 230. Thus, certain embodiments described herein advantageously increase the lifetime of the resulting fluorescent lamp.

Figure 7:
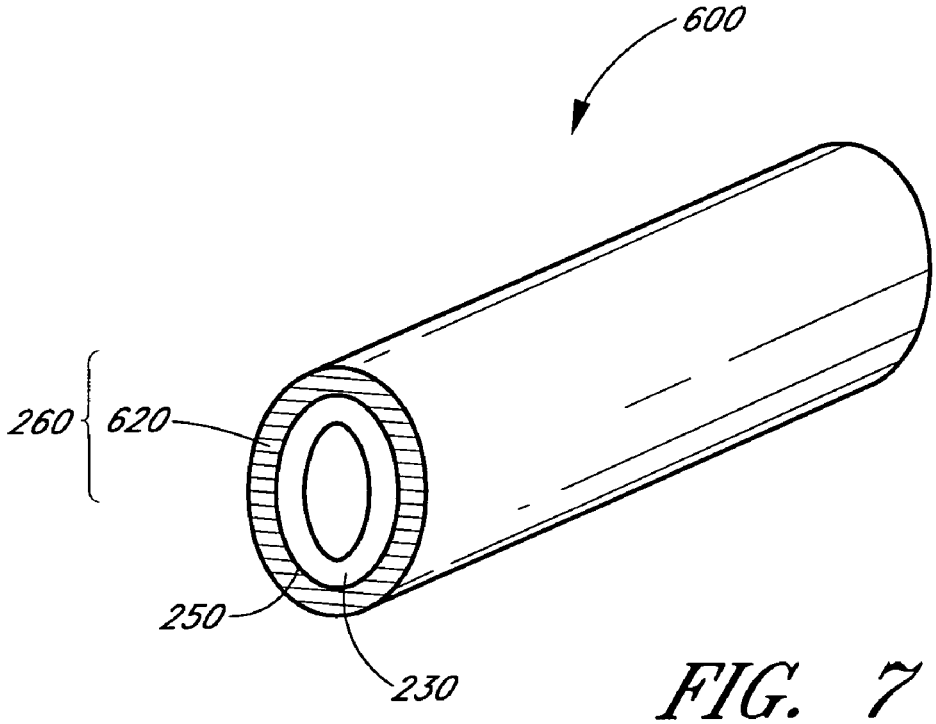
FIG. 7 schematically illustrates another embodiment of a tubular lamp stock having at least one coating which does not comprise a phosphor material and which is formed in accordance with embodiments described herein.

In certain other embodiments, as schematically illustrated by FIG. 7, the at least one coating 260 comprises a protective material 620 but does not comprise a phosphor material. Certain such embodiments are compatible with use of the tubular lamp stock 600 to manufacture ultraviolet sterilizing lamps or neon lamps. While the protective material 620 is not protecting a phosphor material, the protective material 620 of certan such embodiments advantageously protects the tube 230 from scratching. In certain embodiments, the protective material 620 comprises silicone or acrylic plastic. Other protective materials 620 compatible with embodiments described herein include, but are not limited to, polyimide. In certain embodiments, the protective material 620 has a thickness of approximately 0.005 inch.

Sealing Lamp Gas within the Tube

Figure 8:
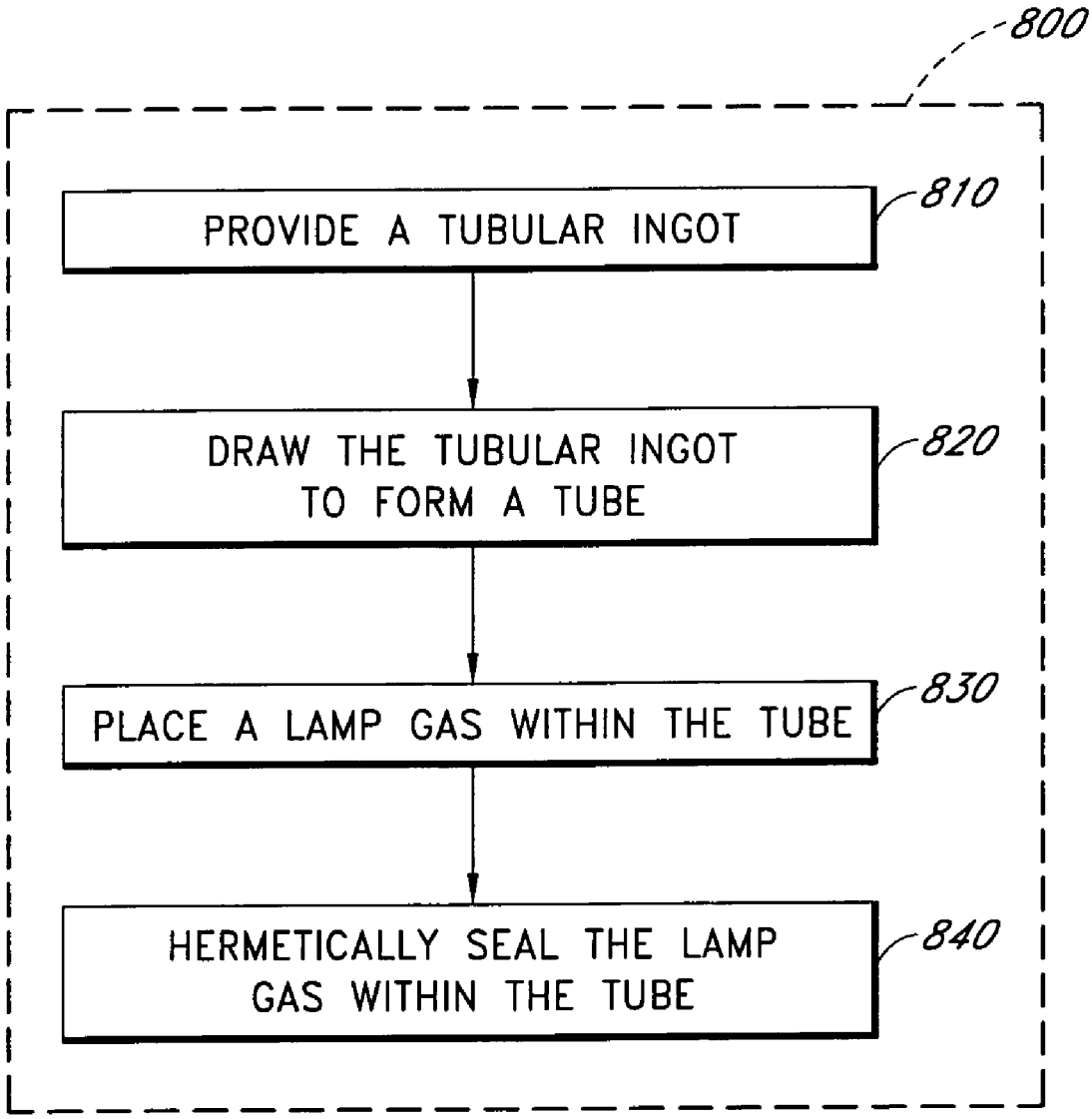
FIG. 8 is a flowchart of a method of manufacturing a tubular gas discharge lamp in accordance with embodiments described herein.

FIG. 8 is a flowchart of a method 800 of manufacturing a tubular gas discharge lamp in accordance with embodiments described herein. The method 800 comprises providing a tubular ingot 210 having a first outer diameter $D_1$ in an operational block 810. The method 800 further comprises drawing the tubular ingot 210 to form a tube 230 with a second outer diameter $D_2$ which is less than the first outer diameter $D_1$ in an operational block 820. The method 800 further comprises placing a lamp gas within the tube 230 in an operational block 830. The method 800 further comprises hermetically sealing the lamp gas within the tube 230 in an operational block 840.

In certain embodiments, providing the tubular ingot 210 of the operational block 810 and drawing the tubular ingot 210 to form the tube 230 of the operational block 820 are performed as described above and by FIGS. 1–7 with regard to forming a tubular lamp stock. In certain such embodiments, the tube 230 has a relatively inert gas (e.g., argon, nitrogen) sealed therein. In certain embodiments, the dry, contaminant-free gas sealed within the tube 230 during the drawing process comprises a lamp gas. For example, neon can be sealed within the tube 230 during the drawing process and the lamp gas can comprise neon (e.g., for a neon lamp). Thus, in certain such embodiments, no further processing is required to place lamp gas within the tube 230 in the operational block 830.

Figure 9:
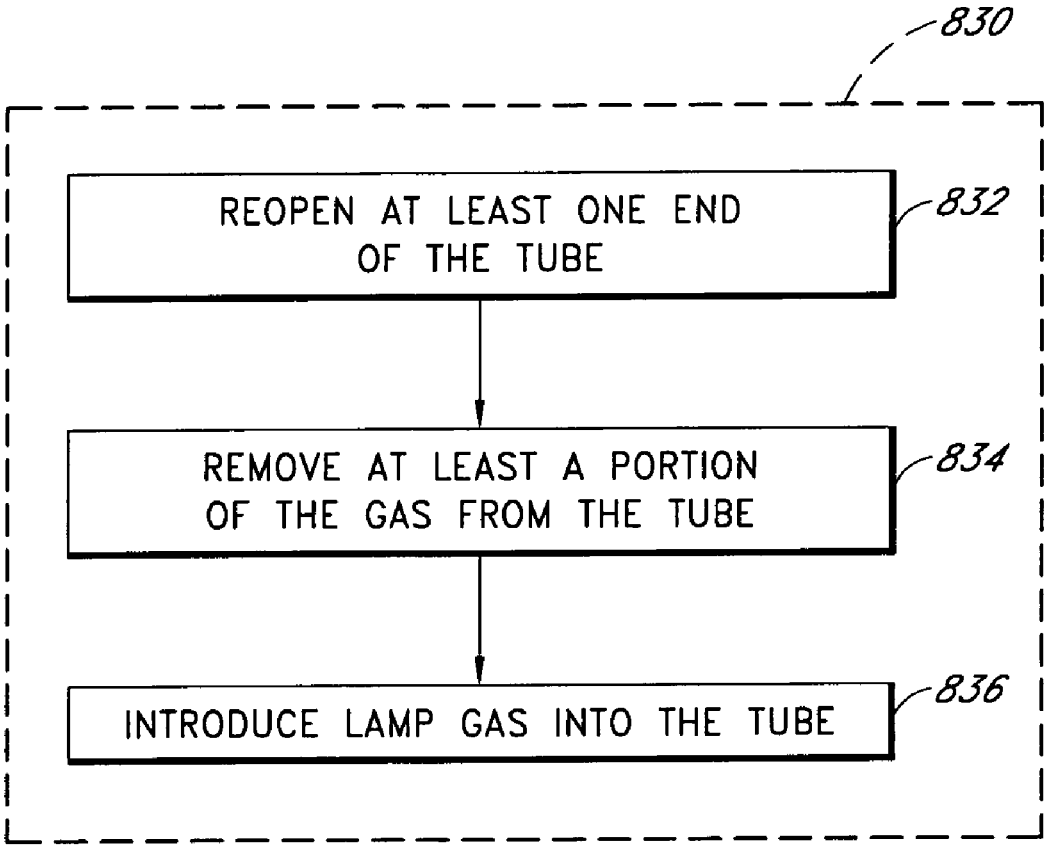
FIG. 9 is a flowchart of one process for placing a lamp gas within the tube in accordance with such embodiments.

In other embodiments in which the gas sealed in the tube 230 during the drawing process does not comprise lamp gas, additional processing steps are used to place the lamp gas within the tube 230 in the operational block 830. FIG. 9 is a flowchart of one exemplary process for placing a lamp gas within the tube 230. In an operational block 832, at least one end of the tube 230 is reopened to provide access to the gas inside of the tube 230. In an operational block 834, at least a portion of the gas is removed from the tube 230. In an operational block 836, lamp gas is introduced into the tube 230.

In certain embodiments, the tube 230 is reopened in the operational block 832 by cutting open at least one end of the tube 230. In other embodiments, both a first end and a second end of the tube 230 are cut open. To avoid contaminants (e.g., water vapor) from entering the tube 230, in certain embodiments, the at least one end of the tube 230 is opened in a controlled environment (e.g., a dry and contaminant-free nitrogen atmosphere or a vacuum).

In certain embodiments, removing at least a portion of the gas in the operational block 834 comprises connecting the at least one opened end of the tube 230 to a gas processing system comprising a vacuum pump and a lamp gas source. In certain embodiments, the tube 230 is reopened prior to connecting the tube 230 to the gas processing system. In certain such embodiments, the at least one opened end of the tube 230 is maintained within the controlled environment until being coupled to the gas processing system.

In other embodiments, the at least one end of the tube 230 is reopened after being connected to the gas processing system. For example, in certain embodiments, the at least one end of the tube 230 is coupled to a gas processing system using flexible plastic tubing over one end portion of the tube 230. This assembly is then pumped down to a selected vacuum pressure, and the plastic tubing is flexed to break the tube 230 within the flexible tubing. The gas within the tube 230 is then exchanged and the tube 230 is then resealed. In certain embodiments, both ends of the tube 230 are coupled to the gas processing system by flexible tubing. In certain embodiments, the assembly is backfilled with a gas (e.g., nitrogen) to a preselected pressure prior to reopening the tube 230. Gas processing systems compatible with embodiments described herein are known to persons skilled in the art.

The vacuum pump of the gas processing system is used to pump out at least a portion of the gas from the tube 230. In certain embodiments, the gas is pumped out to a predetermined vacuum pressure (e.g., less than 1 Torr). In certain embodiments in which the gas sealed within the tube 230 already comprises a lamp gas and the gas is at a higher pressure than the desired lamp gas pressure, the gas is pumped out to the desired lamp gas pressure.

The lamp gas is then introduced into the tube 230 from the lamp gas source of the gas processing system. The lamp gas of certain embodiments comprises at least one of the following gases: mercury vapor, argon, and neon. In certain embodiments, the lamp gas comprises a mixture of one or more of these gases (e.g., argon and mercury vapor mixture). The lamp gas has a pressure substantially less than atmospheric pressure. In certain embodiments, the lamp gas has a pressure in a range between approximately 1 Torr and approximately 200 Torr, while in other embodiments, the vacuum pressure is approximately equal to 25 Torr. In this way, introduction of the lamp gas within the tube 230 in certain embodiments is performed by a simple exchange or adjustment of atmospheres which can be performed at room temperature or at slightly elevated temperatures.

In certain embodiments, the lamp gas is sealed within the tube 230 by resealing (e.g., by torch sealing or by hot pliers sealing) the at least one opened end of the tube 230. The tube 230 is then removed from the gas processing system.

In certain embodiments, a tubular lamp stock comprises the tube 230 with lamp gas sealed within the tube 230. In certain embodiments, the tube 230 has a length of at least 12 feet, at least 30 feet, or at least 100 feet. In certain embodiments, the tube 230 has sufficient flexibility to flexibly bend along a bending radius equal to or less than approximately 6 feet, equal to or less than approximately 4 feet, or equal to or less than approximately 2 feet.

In embodiments in which the tube 230 is longer than the desired lamp length, the tube 230 is separated into tube segments, each tube segment having a desired length for the gas discharge lamp. In certain embodiments, the length of the tube segment is between approximately 1 inch and approximately 40 inches, while in other embodiments, the tube segment length is approximately 15 inches. In certain embodiments, each tube segment is separately sealed with the lamp gas therein, while in other embodiments, the entire tube 230 is filled with the lamp gas at once and is then separating into tube segments.

Electrodes

Figure 10:
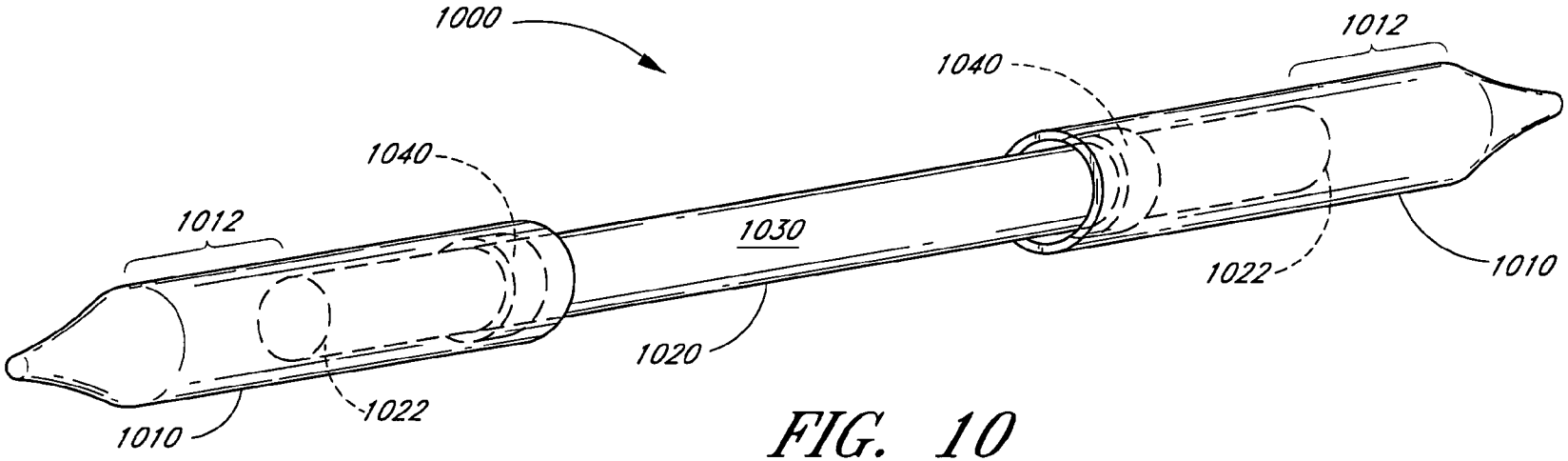
FIG. 10 schematically illustrates a tubular gas discharge lamp with electrodes at each end of the tube in accordance with embodiments described herein.

FIG. 10 schematically illustrates a tubular gas discharge lamp 1000 with metallic electrodes 1010 at each end 1022 of the tube 1020. In certain embodiments, the inner surfaces of the metallic electrodes 1010 are in physical contact with the lamp gas 1030 within the tube 1020. Such gas discharge lamps 1000 utilize seals 1040 between the glass tube 1020 and the metallic electrode 1010 to seal the lamp gas 1030 within the tube 1020. In certain embodiments, the materials of the glass tube 1020, the seals 1040, and the metallic electrodes 1010 are selected to have compatible coefficients of thermal expansion to avoid opening of the glass-to-metal seals 1040 due to heat generated by operation of the gas discharge lamp 1000.

However, in certain embodiments, the coefficients of thermal expansion (CTE) of the tube 1020 and the electrodes 1010 are different. For example, in certain embodiments, the tube 1020 (e.g., quartz) has a CTE of approximately $0.5\times10^{-6}$/inch/degree Celsius and the electrode 1010 has a CTE of approximately $14\times10^{-6}$/inch/degree Celsius. In certain such embodiments, the seals 1040 between the tube 1020 and the electrode 1010 are spaced away from the respective ends 1022 of the tube 1020. Electron emission from the electrode 1010, and the corresponding electrode heating, primarily occurs at regions 1012 near the ends 1022 of the tube 1020. The heat from the electron emission is dissipated by the tube 1020 and the electrode 1010 prior to reaching the seal 1040. Thus, by spacing the seals 1040 away from these regions 1012, such embodiments advantageously avoid heating the seals 1040 and advantageously avoid opening of the seals 1040 in response to thermal effects. Certain other embodiments comprise a heat sink (not shown) to further dissipate the heat from electron emission before it can reach the seals 1040.

For example, in certain embodiments in which the electrode emission regions 1012 operate at approximately 500 degrees Celsius, the temperature of the seals 1040 is approximately 150 to 300 degrees Celsius. In such embodiments, it is possible to use a silicone adhesive, an epoxy, or other high-vacuum polymer for the seal 1040. In certain embodiments, the seal 1040 comprises a material which does not require processing at temperatures greater than approximately 150 degrees Celsius. Other materials for the seals 1040 include, but are not limited to, single-part materials that are air- or heat-cured or two-part materials that are cured by chemistry-, air-, or heat-cured. Exemplary seal materials include, but are not limited to, silicone or vacuum epoxies (e.g., Torr Seal® low-vapor-pressure epoxy resin sealant available from Varian Inc. of Palo Alto, Calif.). The seal material can be applied as a liquid, paste, or as a preformed shape.

Because the inner surfaces of the electrodes 1010 are in physical contact with the lamp gas 1030, in certain embodiments, the electrodes 1010 and the tube 1020 are advantageously exposed to high-temperature vacuum processing (e.g., by baking while pumping to a selected vacuum pressure) to remove contaminants which would otherwise contaminate the lamp gas 1030. After vacuum processing, lamp gas 1030 is introduced into the tube 1020, and the electrodes 1010 are then sealed (e.g., crimped) onto the ends of the tube 1020, thereby sealing the lamp gas 1030 within the tube 1020.

While the gas discharge lamps manufactured in this way have one or more advantages over prior art gas discharge lamps (e.g., small diameters, external phosphor material, flexibility), such manufacturing processes still utilize a high-temperature vacuum processing step subsequent to formation of the small-diameter tube and the phosphor coating. It is desirable to avoid such high-temperature vacuum processing steps so as to avoid the corresponding degradation of the phosphor material and to simplify the manufacturing process.

Figure 11:
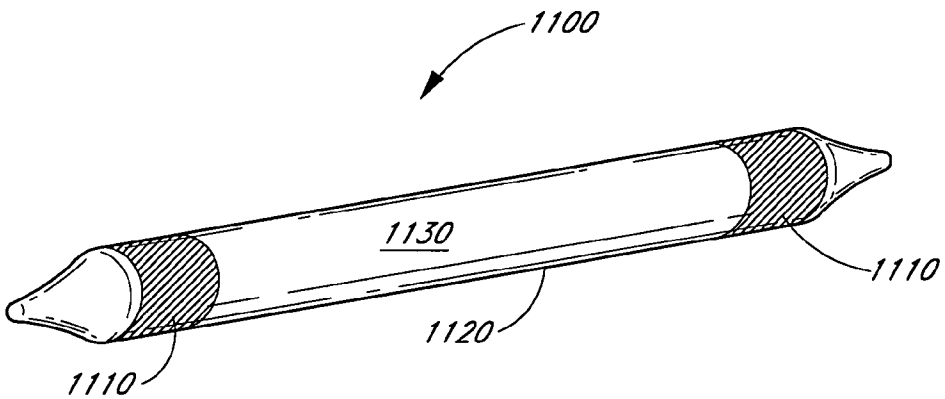
FIG. 11 schematically illustrates an electrodeless configuration of a gas discharge lamp in accordance with embodiments described herein.

FIG. 11 schematically illustrates a gas discharge lamp 1100 with external electrodes 1110 at respective ends of the tube 1120. In certain embodiments, such external metallic electrodes 1110 are formed over the sealed tube 1120 and are used to excite the lamp gas 1130 sealed within the tube 1120. The external electrodes 1110 are capacitively coupled to the lamp gas 1130 from outside the tube 1120. By applying an AC voltage (e.g., approximately 100 to 200 kHz) to the external electrodes 1110, the lamp gas 1130 is ionized, becomes a conductor, and emits ultraviolet light upon discharging. In such configurations, sometimes termed "electrodeless," the external electrodes 1110 are not in physical contact with the lamp gas 1130 sealed within the tube 1120.

In certain embodiments, the external electrodes 1110 are formed on the sealed tube 1120 by applying a conductive coating to the two ends of the tube 1120. In certain embodiments, a conductive epoxy is applied to the tube 1120 to serve as the external electrodes 1110. Exemplary materials for the conductive coating include, but are not limited to, copper- or silver-bearing conductive epoxy, metallic sprays, foil wrap, or separate connectors using conductive foam into which the tube 1120 is inserted. In certain embodiments, the external electrodes 1110 advantageously avoid the sputtering of electrode material. Certain other embodiments advantageously avoid dry etching of "pinholes" through the glass under the external electrode 1110 by selecting etch-resistant glass materials (e.g., quartz) for the tube 1120.

In addition, certain embodiments utilizing external electrodes 1110 advantageously avoid the high-temperature vacuum processing steps described above which are used to remove contaminants from electrodes as schematically illustrated by FIG. 10. Such manufacturing processes are therefore advantageously simplified. Because contaminants are removed from within the tube 1120 prior to the application of the phosphor material on the tube 1120, external electrode configurations, such as that schematically illustrated by FIG. 11, advantageously avoid the phosphor degradation corresponding to these high-temperature vacuum processing steps. In addition, certain embodiments utilizing the external electrodes 1110 do not require glass-to-metal seals and advantageously avoid problems associated with such glass-to-metal seals.

Backlight and Display Assemblies

Small gas discharge lamps (e.g., fluorescent lamps) can be used in backlight assemblies designed to provide light for liquid-crystal display (LCD) assemblies in miniature lighting applications. For example, in certain embodiments, the backlight assembly comprises a gas discharge lamp installed in an optical cavity. The backlight assembly of certain embodiments further comprises filters or diffusers to improve the uniformity of the light distribution from the backlight assembly. The display assembly comprises the backlight assembly and the LCD. The backlight assembly is positioned behind the LCD to shine light at the LCD.

In other embodiments, the backlight assembly comprises a gas discharge lamp and a waveguide having an output face. The gas discharge lamp is positioned at an edge of the waveguide. Light from the gas discharge lamp propagates in the waveguide. The backlight assembly is positioned such that light is dispersed through the output face of the waveguide towards the LCD. In certain such embodiments, the diameter of the gas discharge lamp is a significant portion of the thickness of the display assembly.

In addition, in certain embodiments, the thickness of the waveguide is advantageously larger than the diameter of the gas discharge lamp. Therefore, gas discharge lamps with larger diameters correspond to thicker, heavier, and more expensive waveguides and display assemblies. Certain embodiments described herein advantageously reduce the diameter of the gas discharge lamp, thereby allowing thinner, lighter, and less expensive display assemblies.

In certain embodiments in which the gas discharge lamp is a fluorescent lamp used as an optical element (e.g., for LCD backlighting), rather than as a simple space lighting source, it is desirable to have the light-emitting surface (i.e., the phosphor material) as near the outer physical surface as possible to minimize distortions of the light as it travels to the optical element (e.g., waveguide). The visible light from conventional fluorescent lamps with the phosphor material on an inside surface of the tube must propagate through the walls of the tube. In contrast, by placing the phosphor material on the outside of the tube and having only a thin protective material on the phosphor material, certain embodiments described herein advantageously provide a reduced diameter of the lighted phosphor material which minimizes such distortions.

Furthermore, by applying the phosphor material on the outside surface of the tube, certain embodiments described herein increase the light output area of the fluorescent lamp, thereby improving the optical efficiency of the fluorescent lamp. For example, for a tube with an outer diameter of 1 millimeter and an inner diameter of 0.6 millimeter (i.e., wall thickness of 0.2 millimeter), applying the phosphor material to the outer surface yields a lighted area circumference of approximately 3.14 millimeters. However, applying the phosphor material to the inner surface of the tube yields a lighted area circumference of only 1.88 millimeters. Thus, by applying the phosphor material to the outside surface of the tube produces an increase of the light output area by approximately 1.67 times, as compared to applying the phosphor material to the inner surface.

Certain embodiments described herein provide gas discharge lamps which have longer lifetimes than lamps formed using conventional techniques. In addition, certain embodiments described herein provide gas discharge lamps with very small diameters and very thin wall thicknesses that are well suited for use in miniature lighting applications. By integrating the vacuum processing steps and the coating steps with continuous tubing production, certain embodiments produce gas discharge lamps with significant cost savings, less complexity, and with more uniform results than lamps produced using conventional techniques. By having integral protective coatings, certain embodiments described herein advantageously avoid problems with assembly and reliability, particularly for miniature electronic lighting applications.

Various embodiments of the present invention have been described above. Although this invention has been described with reference to these specific embodiments, the descriptions are intended to be illustrative of the invention and are not intended to be limiting. Various modifications and applications may occur to those skilled in the art without departing from the true spirit and scope of the invention as defined in the appended claims.

What is claimed is:

1. A tubular lamp comprising:

a tube having an outer surface and an inner region containing a gas, the tube substantially transmissive to ultraviolet light, the gas generating ultraviolet light in response to electrical excitation;

at least one electrode on the outer surface of the tube, the at least one electrode capacitively coupled to the gas;

a phosphor material on the outer surface of the tube, the phosphor material generating visible light in response to excitation by ultraviolet light from the gas; and a protective material on the outer surface of the tube, the protective material providing environmental protection and mechanical protection to the phosphor material.

2. The tubular lamp of claim 1, wherein the tube has an outer diameter of less than approximately 3 millimeters.

3. The tubular lamp of claim 1, wherein the tube has an inner diameter of less than approximately 3 millimeters.

4. The tubular lamp of claim 1, wherein the tube has a wall thickness less than approximately 0.3 millimeters.

5. The tubular lamp of claim 1, further comprising an intervening material between the tube and the phosphor material.

6. The tubular lamp of claim 5, wherein the intervening material is substantially transmissive to ultraviolet light and is substantially reflective to visible light.

7. The tubular lamp of claim 1, further comprises an intervening material between the phosphor material and the protective material.

8. The tubular lamp of claim 7, wherein the intervening material is substantially reflective to ultraviolet light and is substantially transmissive to visible light.

9. The tubular lamp of claim 8, wherein the phosphor material and the protective material are mixed together in a coating.

10. The tubular lamp of claim 1, wherein the gas has a pressure substantially less than atmospheric pressure.

11. The tubular lamp of claim 1, wherein the gas comprises at least one of the following gases: mercury vapor, argon, and neon.

12. The tubular lamp of claim 1, wherein the tube has sufficient flexibility to flexibly bend along a bending radius equal to or less than approximately 6 feet.

13. The tubular lamp of claim 1, wherein the at least one electrode is not in physical contact with the gas.

14. The tubular lamp of claim 1, wherein the at least one electrode comprises two electrodes positioned at respective ends of the tube.

15. The tubular lamp of claim 1, wherein the at least one electrode comprises a conductive coating applied to the tube.

16. The tubular lamp of claim 15, wherein the conductive coating comprises a conductive epoxy.

17. The tubular lamp of claim 15, wherein the conductive coating comprises at least one of the group consisting of: copper-bearing conductive epoxy, silver-bearing conductive epoxy, metallic spray, foil wrap, and conductive foam.

* * * * *